United States Patent [19]

Hess

[11] 4,254,584

[45] Mar. 10, 1981

[54] OPERATING MECHANISM FOR A MOTORCAR WINDOW

[75] Inventor: Peter Hess, Coburg, Fed. Rep. of Germany

[73] Assignee: Metallwerk Max Brose GmbH, Coburg, Fed. Rep. of Germany

[21] Appl. No.: 71,543

[22] Filed: Aug. 31, 1979

Related U.S. Application Data

[63] Continuation of Ser. No. 854,138, Nov. 23, 1977, Pat. No. 4,201,014.

[30] Foreign Application Priority Data

Dec. 13, 1976 [DE] Fed. Rep. of Germany ..... 2656428

[51] Int. Cl.[3] ..... E05F 11/48

[52] U.S. Cl. ..... 49/325; 49/352

[58] Field of Search ..... 49/325, 352, 350, 349, 49/348, 360; 74/422, 501 P

[56] References Cited

U.S. PATENT DOCUMENTS

| | | | |
|---|---|---|---|
| 3,444,649 | 5/1969 | Rivolier | 49/352 |
| 3,554,050 | 1/1971 | Conrad | 74/501 P |
| 3,657,942 | 4/1972 | Sullivan | 74/501 P |
| 3,681,874 | 8/1972 | Golde et al. | 49/352 |
| 3,890,743 | 6/1975 | Eckhardt et al. | 49/352 |

*Primary Examiner*—Philip C. Kannan

*Attorney, Agent, or Firm*—Toren, McGeady and Stanger

[57] ABSTRACT

The bowden cable drivingly connecting a crank on a motorcar door to a carrier for the window in the door has a plastic compression member whose ends abuttingly engage retaining members near the crank and the window carrier. The ends are of non-circular cross section, and their angular movement about the longitudinal axis of the cable is prevented by conforming engagement with respective retaining members.

6 Claims, 6 Drawing Figures

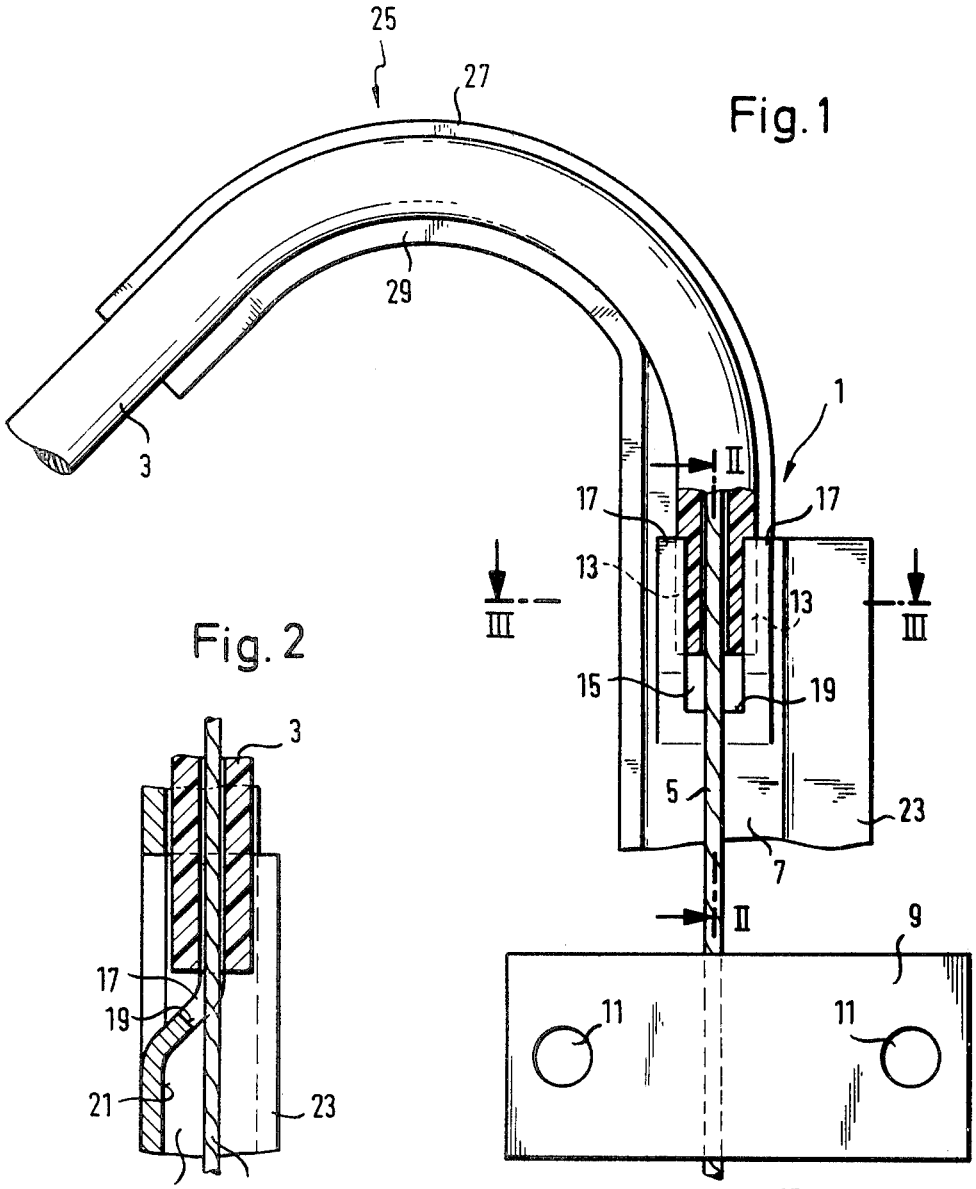
Fig. 1
Fig. 2
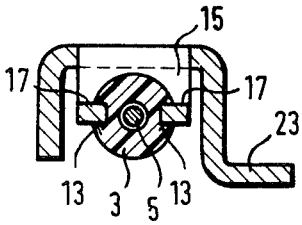
Fig. 3

Fig.4
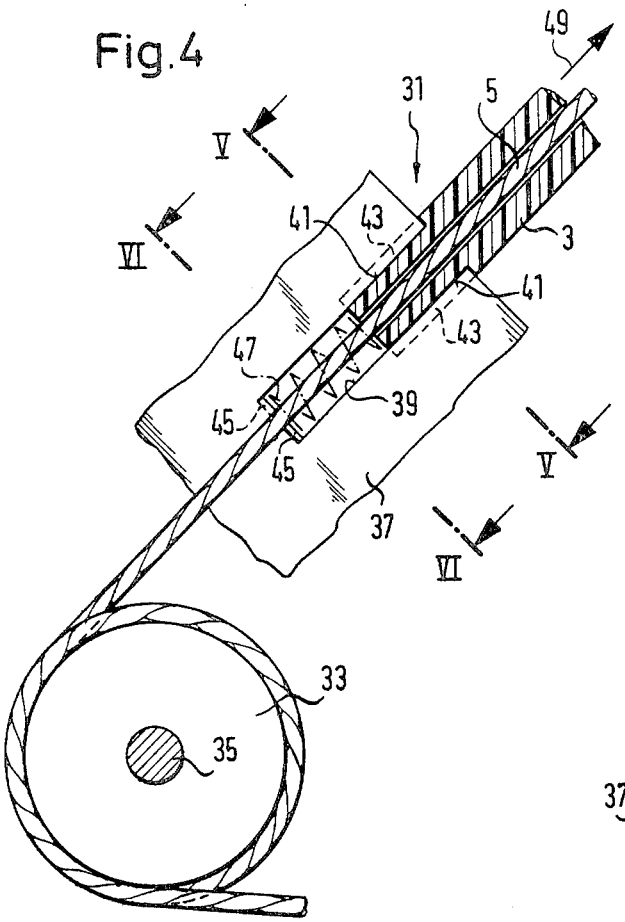
Fig.5
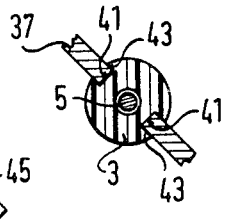
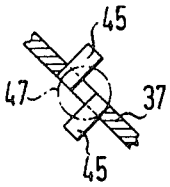
Fig.6

OPERATING MECHANISM FOR A MOTORCAR WINDOW

This is a continuation of Application Ser. No. 854,138 filed on Nov. 23, 1977, now U.S. Pat. No. 4,201,014.

This invention relates to window operating mechanisms for windows in doors of motorcars and the like, and particularly to an improved window operating mechanism of the type in which the tension member of a bowden cable drivingly connects a carrier for the window to a manually operated driving device, and respective, longitudinally terminal portions of the tubular compression member of the cable are associated with retaining members near the carrier and the driving device.

A window operating mechanism of the type described is known from U.S. Pat. No. 3,444,649. It includes a bowden cable whose tension member is a wire rope guided in a closed loop in rigid tubes. Assembly of the known mechanism would be greatly facilitated if the rigid tubes could be replaced by flexible compression members. However, the longitudinal portion of the bowden cable in mechanisms of this type has to extend in an arc of 90° or more contiguously adjacent the carrier for the window, and the stresses caused thereby in a conventional, metallic compression member during normal operation unacceptably shorten the useful life of the window mechanism.

It is a primary object of this invention to provide a window operating mechanism of the known type with a flexible bowden cable of withstanding the operating stresses of the mechanism over a long period.

With this object and others in view, as will presently become apparent, the invention provides a window operating mechanism of the basically known type in which a window carrier is movable in a predetermined path. The tension member of a bowden cable drivingly connects the window carrier to a driving device. The compression member of the bowden cable is formed with a longitudinal bore therethrough in which the tension member is received. Retaining devices associated with respective, longitudinally terminal portions of the compression member adjacent the carrier and the driving device abuttingly retain the associated terminal portions.

According to the invention, the compression member may be made flexible without impairing the operation and useful life of the operating mechanism because at least one of the longitudinally terminal portions is of non-circular cross section, and the associated retaining device includes a retaining member conformingly engaging the non-circular terminal portion and thereby preventing angular movement of the engaged portion about an axis which is longitudinal of the bowden cable. Such angular movement has been found to be at the root of short service life of earlier mechanisms which were equipped experimentally with flexible bowden cables.

Other features, additional objects, and many of the attendant advantages of this invention will readily be appreciated as the same becomes better understood by reference to the following detailed description of a preferred embodiment when considered in connection with the appended drawing in which:

FIG. 1 shows a portion of a window operating mechanism of the invention in side elevation and partly in section;

FIGS. 2 and 3 show respective parts of the device of FIG. 1 in sections on the lines II—II and III—III;

FIG. 4 illustrates another portion of the same mechanism in a view corresponding to that of FIG. 1; and FIGS. 5 and 6 show respective parts of the device of FIG. 4 in sections on the lines V—V and VI—VI.

Referring initially to FIG. 1, there is seen a retaining assembly 1 for one longitudinally terminal portion of a compression member 3 of a bowden cable whose tension member 5 is a wire rope. The flexible compression member 3 is a plastic tube of polypropylene or at least including an innermost tubular layer of polypropylene combined with one or more layers of other synthetic resin compositions. The terminal portion of the member 3 seen in FIG. 1 is secured by the retaining assembly 1 to a channel-shaped sheet metal guide 7 for a window carrier 9. The window, not itself seen in the drawing, is normally attached to the carrier 9 by fasteners passing through mounting apertures 11 in the carrier.

As is better seen in FIG. 3, the plastic tube 3 is formed with two longitudinally terminal grooves 13 in a common plane through the longitudinal axis of the bowden cable which are engaged by parallel, elongated branch portions 17 of a retaining fork 15. As is evident from joint consideration of FIGS. 2 and 3, the fork 15 is an integral sheet metal portion of the carrier guide 7. The stem portion 19 of the fork 15 extends away from the web 21 of the guide 7 so that the wire rope 5 freely moves through the guide 7 without being subjected to frictional wear. The tongue-and-groove connection of the branch portions 17 and the tube 3 prevents any twisting of the tubular compression member 3.

The window carrier 9 is fastened to the wire rope 5 in a known manner, not explicitly illustrated, and is guided by a flange 23 of the guide 7, and otherwise by sliding movement of the non-illustrated window in the car door, as is common practice.

A guide channel 25 extends from the guide 7 in an arc of more than 90° and receives the central portion of the plastic tube 3. The channel 25 is L-shaped in cross section and consists of a flat bottom wall 27 parallel to the web 21 of the guide 7, and an arcuate side wall 29 bounding the concave side of the channel 25 and perpendicular to the bottom wall 27. Buckling of the bowden cable is safely prevented by the channel 25.

The other axially terminal portion of the plastic tube 3 and associated elements are shown in FIG. 4. The retaining assembly 31 associated with the other terminal portion essentially consists of a metal plate 37 which is fixedly fastened to the door frame in the same manner, not shown, as the guide 7. The bowden cable extends from the guide channel 25 in a straight path into an elongated slot 39 of the plate 37. Edges 41 of the plate which laterally bound the slot 39 are received in longitudinal grooves 43 of the tube 3 identical with the grooves 13 shown in FIGS. 1 and 3, the engagement of the edges 41 with the grooves 43 being best seen in FIG. 5.

Lugs 45 are bent out of the plane of the plate 37 at the bottom of the slot 39, as is shown in FIG. 6, to provide a seat for a helical compression spring 47 coiled about the portion of the wire rope 5 which projects from the plastic tube 3 toward a cable drum 33 on a shaft 35 journaled in the door frame and carrying a crank for manual rotation of the drum 33 as is conventional, but not shown. The spring 47 holds the plastic tube 3 under longitudinal compressive stress as indicated by an arrow 49. The portion of the plate 37 adjacent the lugs 45 is bent so as to clear the wire rope 5 and avoid frictional wear.

As is not explicitly shown in the drawing, the wire rope 5 forms a closed loop. The portion not shown in the drawing extends from the drum 33 through another plastic tube identical with the tube 3 to the portion of the mechanism illustrated in FIG. 1. The non-illustrated plastic tube is guided from the drum 33 to the window carrier 9 in an arcuate guide channel analogous to the channel 25, and its two longitudinally terminal portions are retained by devices of the types shown in FIGS. 1 and 4 respectively. The illustrated structure thus is substantially duplicated in the non-illustrated portion of the mechanism with the exception of the driving device represented by the drum 33 and the shaft 35.

It should be understood, of course, that the foregoing disclosure relates only to a preferred embodiment, and that it is intended to cover all modifications and variations of the example of the invention herein chosen for the purpose of the disclosure which do not constitute departures from the spirit and scope of the invention set forth in the appended claims.

What is claimed is:

1. In a window operating mechanism including a window carrier movable in a predetermined path, a driving device, an elongated bowden cable including a tension member and a compression member, said tension member drivingly connecting said carrier and said device, and said compression member being formed with a longitudinal bore therethrough receiving said tension member, and retaining means associated with respective, longitudinally terminal portions of said compression member adjacent said carrier and said device respectively for abuttingly retaining the associated portions, the improvement which comprises:

(a) said compression member being an axially tubular member formed of a flexible plastic material, and at least one of said longitudinally terminal portions of said flexible tubular member being integral therewith and formed with two diametrically opposed longitudinal grooves having bottoms and extending inwardly from the outside surface of said tubular member without penetrating the tubular member so that each of the grooves has a bottom spaced from the inside surface of said tubular member and (b) the retaining means associated with said one portion including a fixedly positioned plate-shaped retaining member formed with an elongated slot bounded by two edge portions extending in the elongated direction of said slot, the spacing between said edge portions being substantially equal to the spacing between the bottoms of said grooves, said edge portions being received in form-fitting engagement with said grooves respectively and thereby preventing angular movement of said one terminal portion about the axis longitudinal of said bowden cable, the length of said edge portions forming said slot being at least equal to the length of said grooves in the axial direction of said tubular member.

2. In a window operating mechanism, as set forth in claim 1, wherein said flexible plastic material comprises at least a layer of polypropylene forming the inside surface of said tubular member.

3. In a window operating mechanism, as set forth in claim 1, wherein said flexible plastic material comprises polypropylene.

4. In a window operating mechanism, as set forth in claim 1 wherein said retaining member being forked and including a stem portion and two branch portions extending from said stem portions in a common direction, said branch portions defining said slot, and said branch portions being elongated and offset from said stem portion transversely to the direction of elongation thereof.

5. In a window operating mechanism, as set forth in claim 1, wherein the length of the edge portions forming said slot being greater than the length of said grooves so that the bottom of said slot extending transversely of said edge portions is spaced from the adjacent terminal portion of said flexible tubular member.

6. In a window operating mechanism, as set forth in claim 5, including yieldable resilient means opposing longitudinal movement of said compression member located between the bottom of said slot and the adjacent terminal portion of said compression member.

* * * * *